US005567046A

United States Patent [19]

Lucas

[11] Patent Number: 5,567,046

[45] Date of Patent: Oct. 22, 1996

[54] STRETCHABLE CHANDELIER ORNAMENT STRING ASSEMBLY

[75] Inventor: John M. Lucas, Cadyville, N.Y.

[73] Assignee: Schonbek Worldwide Lighting Inc., Plattsburgh, N.Y.

[21] Appl. No.: 491,265

[22] Filed: Jun. 16, 1995

[51] Int. Cl.[6] ..... F21V 5/06; F21V 17/00

[52] U.S. Cl. ..... 362/405; 362/457; 362/806; 362/433

[58] Field of Search ..... 362/405, 339, 362/457, 806, 306, 147, 433, 434, 440, 444, 452

[56] References Cited

U.S. PATENT DOCUMENTS

| | | | |
|---|---|---|---|
| 401,934 | 4/1889 | D'Humy | 362/433 |
| 3,820,201 | 6/1974 | Burckhardt | 362/457 |
| 5,144,541 | 9/1992 | Schonbek | 362/405 |
| 5,241,460 | 8/1993 | Schonbek | 362/405 |
| 5,285,364 | 2/1994 | Bayer | 362/405 |

*Primary Examiner*—Denise L. Gromada
*Assistant Examiner*—Thomas M. Sember
*Attorney, Agent, or Firm*—Wolf, Greenfield & Sacks, P.C.

[57] ABSTRACT

A stretchable chandelier ornament string assembly provides a plurality of elongated spring elements joined by a common runner and formed from a continuous piece of flat spring material stock. The runner is attached to a chandelier frame and each of the spring elements engages a chandelier ornament string. Displacement of the spring elements generates tension in the ornament strings to maintain the ornament strings in substantial predetermined alignment. The spring assembly can be formed into a non-planar orientation by the chandelier frame to generate a variety of shapes and patterns of chandelier string attachment locations.

20 Claims, 12 Drawing Sheets

STRETCHABLE CHANDELIER ORNAMENT STRING ASSEMBLY

FIELD OF THE INVENTION

This invention relates to a stretchable ornament string assembly for a chandelier and more particularly to a spring structure that is mountable of a chandelier frame for providing tension to a multiplicity chandelier ornament strings.

BACKGROUND OF THE INVENTION

It is often desirable in the construction of chandeliers to position strings or chains of crystal ornaments between two attachment locations on the chandelier frame. In many instances, the attachment locations are oriented so that the s ornament string or chain extends transversely to the direction of gravity. If there is slack in the string as it is suspended between attachment locations, the string sags or droops, generating a potentially-undesirable curvature or misalignment in the ornament arrangement. Simply extending the distance between frame members until all strings are tensioned can cause the already-tensioned strings to break. By "chain" or "string" of ornaments it is contemplated a group of chandelier ornaments, such a cut crystals, that are joined by links. For the purpose of this description, however, a "chain" or "string" can also include a single ornament held between a pair of frame members by, for example, links.

A prior art technique for removing slack in ornament strings involves the connection of an individual spring between one of the attachment locations and the string. The string is, generally, shorter than the straight-line distance between the two attachment locations, creating a gap. The stretched spring spans the gap and exerts a tension force on the string relative to the other attachment location. U.S. Pat. No. 5,241,460 to Arnold Schonbek, which is expressly incorporated herein by reference, discloses an arrangement in which such individual springs are positioned between an ornament chain and a frame member.

The use of springs at the end of ornament strings enables each of the strings in a group to be tensioned in a relatively-straight alignment between two attachment locations on a chandelier frame. Springs automatically accommodate variations in distance between attachment locations, since the springs stretch, within predetermined limits, while maintaining a continuous tension force.

However, the additional step of attaching individual springs between the frame and each string adds further complication to the building process and entails a greater investment in time and labor to construct a chandelier. As the number of ornaments on a given chandelier frame increase, the additional labor involved also increases proportionally.

It is, therefore, an object of the present invention to provide a method and apparatus for tensioning chandelier ornament strings or chains that does not entail the use of discrete springs at each attachment location. Stretchable ornament strings according to this invention should be easily placed into tension, easy to manufacture and applicable to a wide-range of chandelier shapes and styles. It is further desirable that stretchable ornament chandelier strings or chains according to this invention be easy to attach and detach to allow rapid assembly and maintenance of the chandelier. Manufacture of spring assemblies according to this example should be easily accomplished by automated processes.

SUMMARY OF THE INVENTION

This invention provides an improved spring assembly for attachment to a chandelier frame that reduces the number of required assembly steps by combining a plurality of spring elements on a common runner. The ornament string assembly according to this invention provides a first ornament string, having a corresponding first and a second ornament string, having a corresponding first end and a second end. The first end of the first ornament and the first end of the second ornament are each attached to respective attachment locations on a chandelier frame. A spring assembly is attached to the frame member. The spring assembly includes a first spring element and a second spring element, interconnected by a common runner. The first and second spring elements generally extend transversely to the common runner and define respective attachment locations for engaging a respective second end of each of the first ornament string and the second ornament string. The first and second spring elements are, thereby, flexed to provide tension to the first and second ornament strings, respectively.

The spring assembly can be formed as an "integral unit" from a single flat piece of spring stock, in which the runner and spring elements are formed together, "free of breaks" therebetween. The spring elements are, typically, elongated leaf springs. The runner can define a ring, a loop or a relatively-linear strip of material. The spring assembly can be formed into a non-planar, three-dimensional, shape by bending the runner to conform to the shape of a substantially-rigid frame member. In one embodiment, the frame member includes a series of holes, or other interengaging formations, that receive at least some of the plurality of spring elements and maintain the runner in a predetermined shape, such as a ring.

In an alternate embodiment, the runner can comprise a continuous ring from which the leaf spring-like spring elements radiate outwardly. The ring is, typically, attached to a center post of a chandelier frame and the ornament strings are oriented transversely to a plane defined by the ring and radial spring elements.

According to another embodiment, the runner can define a semicircular strip that is retained within the inner circumference of a ring-like frame member and, thereby, forms a frustoconical array of spring elements. In this embodiment and in others, the spring force of the runner can act to maintain the spring assembly in engagement with the chandelier frame member. In yet other embodiments, the runner can be physically attached to the chandelier frame by fasteners.

A method for tensioning a plurality of chandelier ornament strings according to this invention entails the use of a spring assembly having a plurality of spring elements interconnected by a common runner. The spring assembly is attached to a chandelier frame member. Each of a plurality of chandelier ornament strings are attached between a respective of the plurality of spring elements and a portion of the chandelier frame that is remote from the spring elements. The spring elements are displaced as the chandelier ornament strings are attached between the spring elements and the frame. The displacement generates a tension force that is imparted to each of the strings.

Each of the components of the chandelier frame and the spring assembly can be constructed from flat sheet material according to this invention using computer-aided manufacturing techniques in conjunction with a laser cutter and/or punch press. The resulting spring assembly structure is easy to assemble, precise and enables rapid attachment and detachment of a group of tensioned ornament strings.

BRIEF DESCRIPTION OF THE DRAWINGS

The foregoing and other objects and advantages of the invention will become clear with reference to the following detailed description as illustrated by the drawings in which.

DETAILED DESCRIPTION

Figure 1:
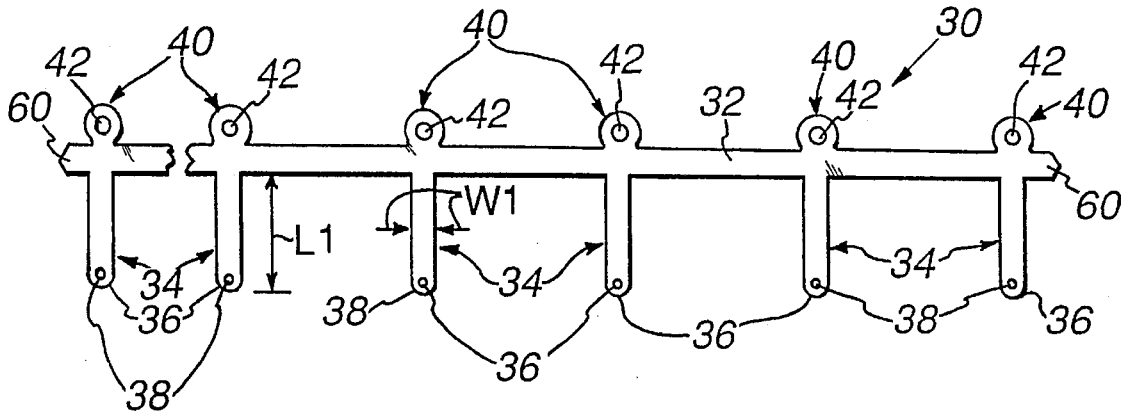
FIG. 1 is a partial plan view of an ornament spring assembly according to an embodiment of this invention.

A spring assembly for tensioning ornament strings, according to one embodiment of this invention, is detailed in FIG. 1. The spring assembly 30 is shown as a partial section of a longer overall spring assembly. The spring assembly according to this embodiment is constructed from 302 stainless steel having a thickness of 0.015 inch and rated "full hard". Spring steel or other flexible materials are also contemplated so long as they are capable of generating a sufficient tension in an ornament string upon deflection of a fraction of an inch. The spring assembly 30 defines an elongated runner section 32 that interconnects a series of perpendicular spring elements 34 that are spaced along the runner 32 at even intervals. The spring elements 34 are formed integrally with the strip from sheet steel stock. In this embodiment, the spring elements 34 extend perpendicularly relative to the direction of elongation of the strip 32. Each spring element 34 has an extended length L1 (taken from the end of the side of the strip 32) of approximately ¾ inch. The elements need not extend perpendicularly. The word "transverse" is also used to describe the relationship of the spring elements to their runner. It contemplates a variety of non-perpendicular angles in which the spring elements can extend from the runner. It is only required that the spring element be able to elastically displace relative to the runner. Each spring element 34 has a width W1 of approximately ⅛ inch. The ends 36 of each spring element 34 are rounded to prevent injury and, as described further below, to enable easier location of the spring elements through holes in the chandelier frame members. Each spring element end 36, according to this embodiment, includes a hole 38 sized for mounting of an ornament string hook therethrough. The exact diameter and configuration of the hole depends upon the type and size of ornament mounted on the spring element 34.

Extending from a side of the strip 32 opposite each spring element 34 is an integrally formed mounting lug 40. The mounting lugs 40 each include a respective hole 42 that, as described below, is sized to receive a rivet, screw or similar attachment device for mounting the spring assembly 30 to a frame member 30. The size of the lug and the diameter of the hole can be altered based upon the size of the fastener to be used.

Figure 2:
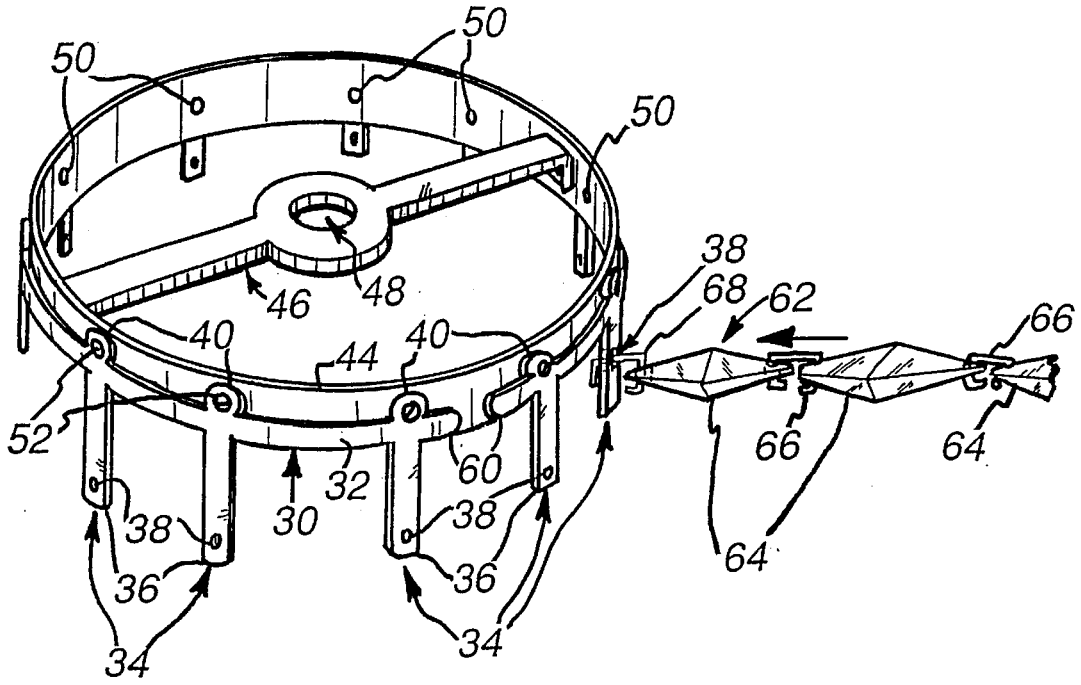
FIG. 2 is a schematic perspective view of the spring assembly of FIG. 1 attached to a chandelier frame member.

With reference to FIG. 2, the spring assembly 30 is shown mounted on a ring-like frame member 44. The frame member 44 includes a central mounting base 46 with a hole 48 that enables the frame member 44 to be positioned on a chandelier rod or another similar light fixture mounting base. The frame member 44 includes holes 50 located at even intervals about its perimeter that are sized and arranged to receive the mounting lugs 40 of the spring assembly. Screws 52 are used to secure the lugs 40 to the ring-like frame member 44. Since the spring assembly 30 is constructed from full hard stainless steel, with a strip 32 that has a relatively thin thickness, the assembly can be bent relatively easily around the ring without permanent ("plastic") deformation of the strip 32. The number of lugs utilized according to this invention can be varied. In other words, every spring element need not have a corresponding mounting lug and the number of mounting lugs can be less than or more than the number of spring elements.

Likewise, the spring assembly 30 can be attached to the frame member in a variety of ways using, for example, screws that are threaded directly to the frame, screws that receive nuts (see FIGS. 4–5), rivets or an outer ring that locks the spring assembly to the inner ring. It should also be clear that the ring need not be round. It can also be square, linear or polygonal. The spring assembly 30 is sized so that its ends 60 oppose each other between two adjacent lug holes on the frame member 44. The ends 60 according to this embodiment are simply rounded. However, it is contemplated that overlapping or interlocking ends can be utilized.

As shown in FIG. 2, a spring element 34 carries an ornament string 62 that, in this embodiment, comprises a series of crystal ornaments 64 joined by links 66. A hook 68 is located at the end of the string 62 and engages the hole 38 in the spring element 34.

Figure 3:
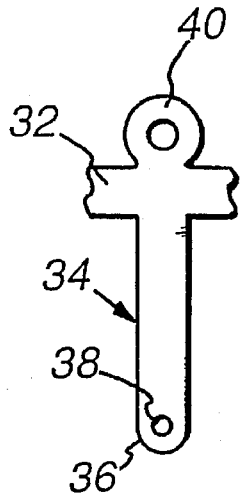
FIG. 3 is a partial plan view of a spring element of the spring assembly of FIG. 1.

The operation of assembling a chandelier ornament string is further detailed with reference to FIGS. 3–5. Each spring element 34 of the assembly 30 (as detailed in FIG. 3) defines an individual leaf spring. By "leaf spring", it is meant that the material has a thickness that is several times less than its width and a length that is, typically, longer than its width. As such, the material flexes along its length L1, inducing a bending moment about the thickness of the spring section 34. The material should be sufficiently flexible to enable the spring section 34 to bend substantially (such as 0.1–0.5 inch linear deflection) before permanent "plastic" deformation occurs. The material should be capable of storing bending energy and producing a spring force in response to induced bending displacement.

Figure 4:
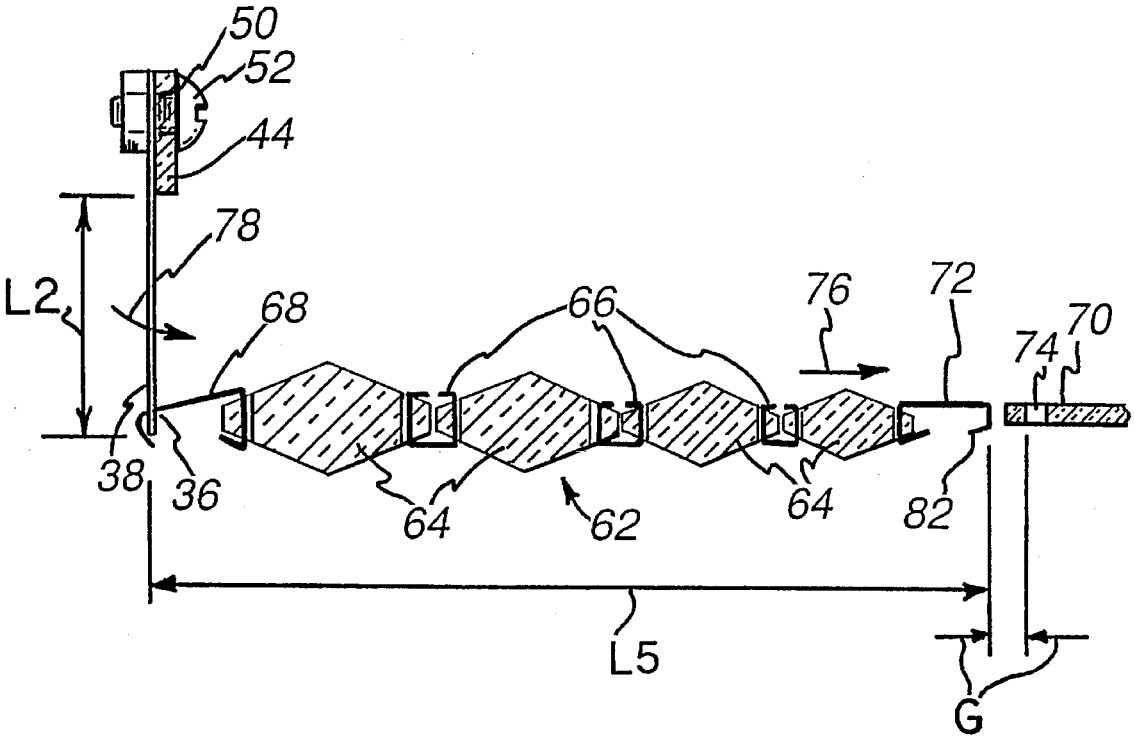
FIG. 4 is a partial side cross-section of the attachment of an ornament string between a frame member and the spring element of FIG. 3.

As shown in FIG. 4, the spring element 34 (which is mounted to the ring 44) is substantially-straight and vertically-oriented in its unbent state. The ornament string 62 is attached by an end hook 68 to the end 36 of the spring section 34 through the hole 38. An opposing frame member 70 is shown. The frame member 70 is supported in this embodiment using supports (not shown) that maintain a fixed distance between the ring frame member 44 and the opposing frame member 70.

The ornament string 62 is sized in length LS so that the end of the opposing hook 72 is separated from the hole 74 of the frame member 70 by a gap G. Thus, to attach the hook 72 to the frame member 70 through the hole 74, the chain 62 must be forced (arrow 76) toward the opposing frame member 70 and away from the ring frame member 44. By forcing the frame member, a bending moment (arrow 78) is induced in the spring section 34. The spring according to this embodiment is sized to resist movement of the chain toward the opposing frame member, but the resisting force is not sufficient to cause the links 66 or the ornaments 64 to break.

Figure 5:
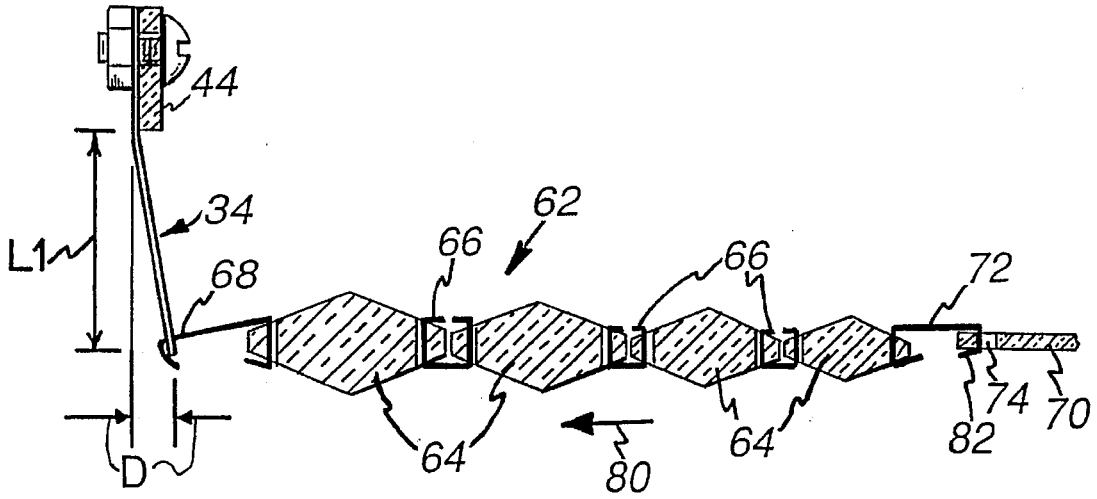
FIG. 5 is a partial side cross-section of the attached string of FIG. 4.

With reference to FIG. 5, the attached ornament string 62 causes a bending displacement in the spring element 34. The displacement D of the spring element 34 is essentially equal to the gap G between the end hooks 72 and hole 74 of the opposing frame member 70. The bend in the spring element induces a tension force within the string 62 that acts in the direction of the arrow 80 away from the opposing frame member 70.

By selecting a spring material of proper resilience, an adequate tension can be induced to generate a substantially linear appearance to the string 62. As noted above, the spring constant should not be so high the force required to displace the spring can cause breakage of the string 62 when it is pulled toward the opposing frame member 70. In other words, the force generated by the displaced spring should be less than the maximum force required to break the ornament string 62. The spring element 34 actually deflects slightly beyond the displacement distance D, according to this embodiment, since the hook 72 includes a lower curbed section 82 that must be encircled through the hole 74 in the opposing frame member 70. As long as the spring element 34 is sufficiently resilient, the user should be able to easily manipulate the end hook 72 (by, for example, rotating the hook) of the string 62 into alignment with the hole 74 and past the end 82 of the hook 72 through the hole 74 to fully engage the hook 72 with the hole 74.

In mounting a chandelier to a frame member having a spring assembly according to this invention, it is also contemplated that the fixed end of the frame can be interconnected with the string first and the spring element can be subsequently moved manually into line with the respective end hook of the string. Once aligned, the end hook and spring element can be interengaged.

Figure 6:
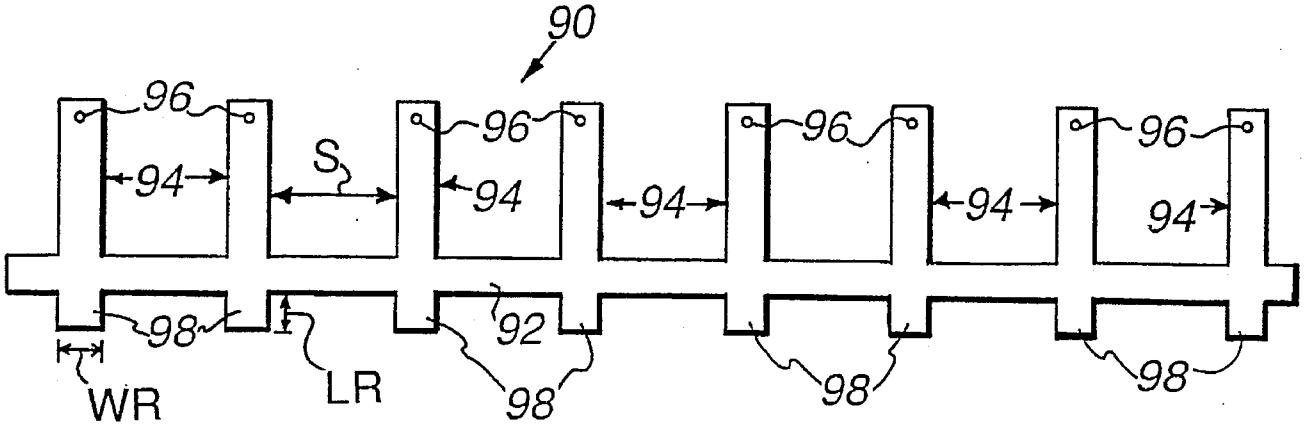
FIG. 6 is a side view of an spring assembly according to another embodiment of this invention.

FIG. 6 details an alternate embodiment for a spring assembly 90 according to this invention. The spring assembly 90 is constructed from 0.015 inch thickness full hard 302 stainless steel, like that of FIG. 1. It includes an elongated runner 92 having transversely-extending spring elements 94 projecting from the runner 92 at even intervals along its length. The spring elements 94 are sized and shaped similarly to the spring elements 34 of FIG. 1. The spring elements 94 include holes 96 at their ends for receiving ornament string hooks. Unlike the spring assembly 30 of FIG. 1, the spring assembly 90 of FIG. 6 includes a set of spring element extensions 98 that project from the opposing side of the runner 92 in line with each spring element 94. As described further below, the length of the runner LR can be varied depending upon the application. The width of the runner WR is the same as that of the spring elements in this embodiment. This width can also be varied depending upon the application.

Figure 7:
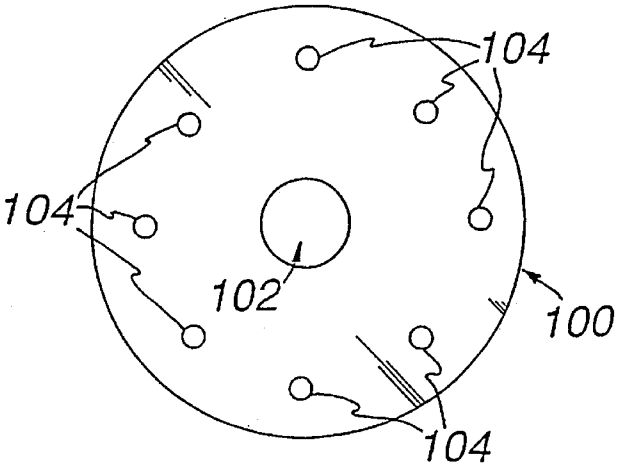
FIG. 7 is a frame member for use with the spring assembly according to FIG. 6.

FIG. 7 illustrates a retaining ring 100 for use with the spring assembly 90 of FIG. 6. In a typical arrangement, two rings 100 are provided. Each of the rings, according to this embodiment, includes a central hole 102 sized to receive a chandelier rod. However, it should be clear that any mounting arrangement, such as spokes, braces, wires or chains can be utilized according to this invention. A series of holes 104 are positioned at even angular distances (are lengths) around the perimeter 100. In this embodiment, the holes 104 have a diameter that is approximately ⅛ inch. The holes 104 are constructed to receive each of the spring elements 94 and opposing extensions 98. The rings 100 and other rigid components described herein can be constructed from mild sheet steel having a thickness of approximately 0.10 inch. Other rigid materials, such as composites or plastics can also be employed.

Figure 8:
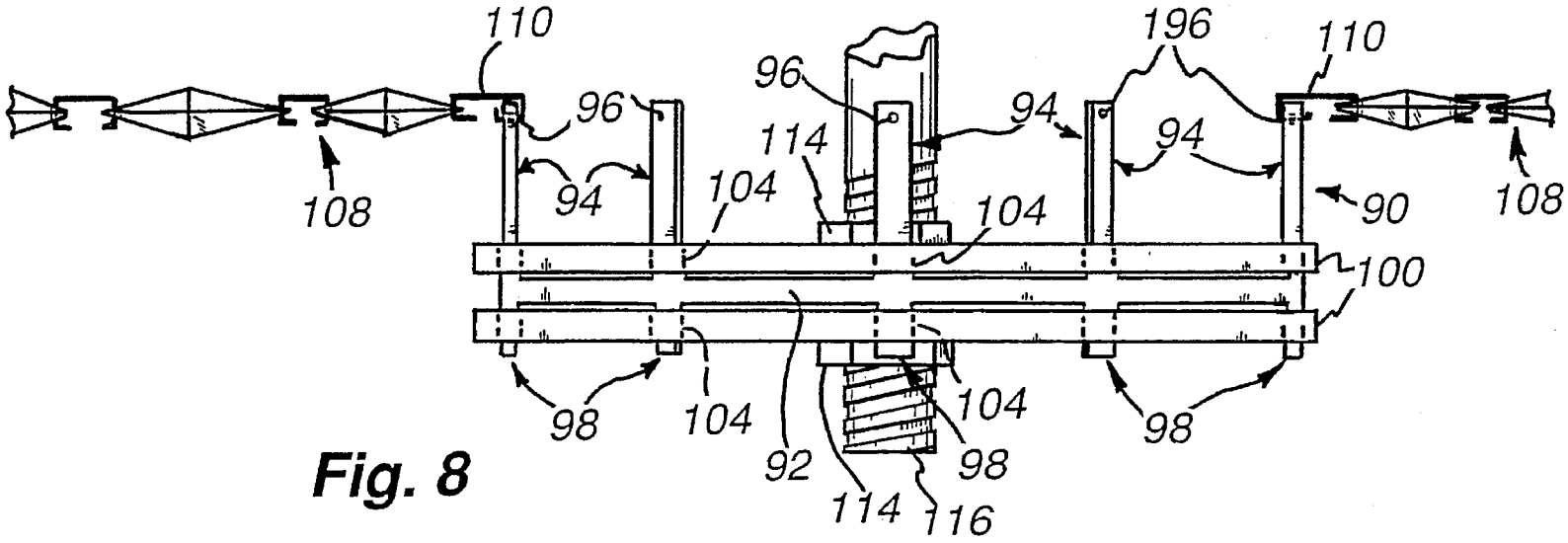
FIG. 8 is a side view of an assembled frame member and spring assembly according to FIGS. 6 and 7.
Figure 9:
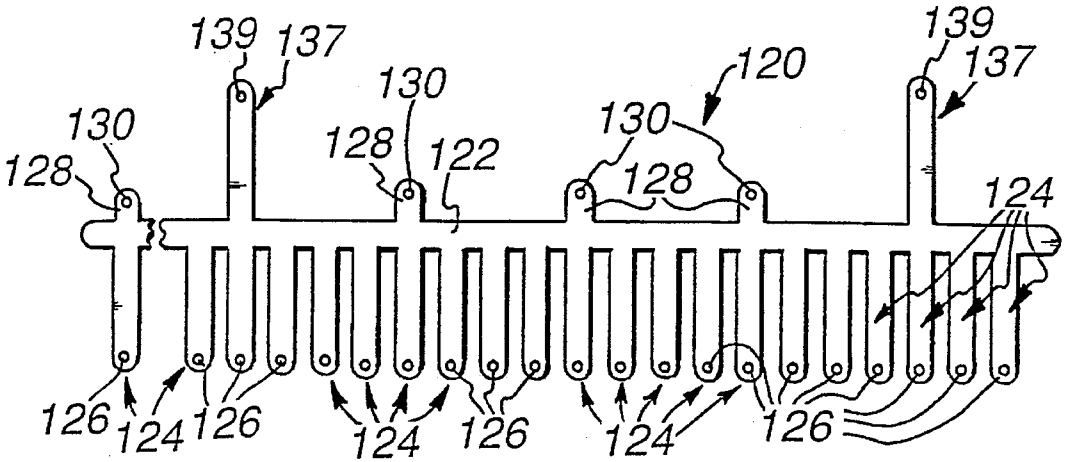
FIG. 9 is a partial side view of a spring assembly according to another embodiment of this invention.

As further detailed in FIG. 8, two rings 100 are positioned over the spring elements 94 and extensions 98, respectively. The spacing S (FIG. 6) between spring elements 94 and extensions 98 should be chosen based upon the angular spacing between holes 104 on the rings 100. So long as the spacing is correct, the spring element 90 can be formed into a circular shape (bending about the runner 92) and each of the rings 100 can be passed over the spring elements 94 and extensions 98, respectively, and into an interlocked relationship. The rings 100 lock the spring assembly 90 into a ring-like configuration with each of the spring elements 94 located at a predetermined angular position about the ring structure.

While the angular distances between holes 104 and spacing S between spring element 94 and extensions 98 is equal, according to this embodiment, it is contemplated that uneven or varied spacings between spring elements and their frame member holes can be employed. For example, adjacent spring elements can alternate about a perimeter between a closer spacing and a further spacing. The ring 100 would have corresponding closer angularly spaced holes and further angularly spaced holes to accommodate the spring elements. Likewise, it is contemplated that several tiers of spring assemblies can be located on a ring. For example, a plurality of concentric circles of spring assemblies having increasingly larger or smaller diameters can be mounted on a single ring with corresponding sets of holes provided for retaining each spring assembly circle on the ring structure.

With reference to FIG. 8, the illustrated embodiment is utilized as a center hub for outwardly-radiating ornament chains 108 attached by hooks 110 to respective elements spring element holes 96. It is contemplated that the outer attachment locations (not shown) would be spaced by a gap distance when the chain is attached to a respective spring element 94 in an unflexed state. By attaching the chain to the outer frame member, flex or deflection is induced in the respective spring element 94. The flex generates a tension that maintains the chain in a taut and linear alignment.

An advantage of the ring structure according to this embodiment is that few screws or fasteners are required to assemble the spring structure into a desired shape. In this embodiment, a pair of nuts 114 provide compression force to hold the rings in close engagement against the runner 92. The nuts 114 are mounted on a threaded rod 116 that can comprise the center of a chandelier. The resulting structure is very precise and rigid with a minimum of misalignment. It is contemplated that other mechanisms for holding the rings 100 in close engagement with the spring assembly 90 can also be utilized such as clamps, springs or individual screws or rivets positioned through the rings in holes provided (not shown).

A variation of the embodiment of FIGS. 6–8 is detailed in FIGS. 9–12. The spring assembly 120, according to this embodiment, comprises a runner 122 having a plurality of closely-spaced spring elements 124 that extend from the runner 122 perpendicularly. The spring elements 124 have a width and length similar to the elements 94 of FIG. 6. Each of the spring elements 124 includes a hole 126 adjacent their outermost ends. A series of extensions 128, having a width approximately equal to that of each spring element 124, are provided along the opposing edge of the runner 122. The extensions 128 are located at intervals adjacent each fourth runner. The extensions also include respective holes 130.

Figure 10:
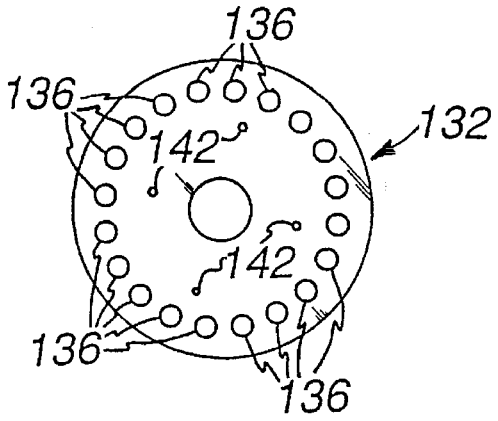
FIGS. 10 and 11 are plan views of frame members for use with the spring assembly according to FIG. 9.
Figure 11:
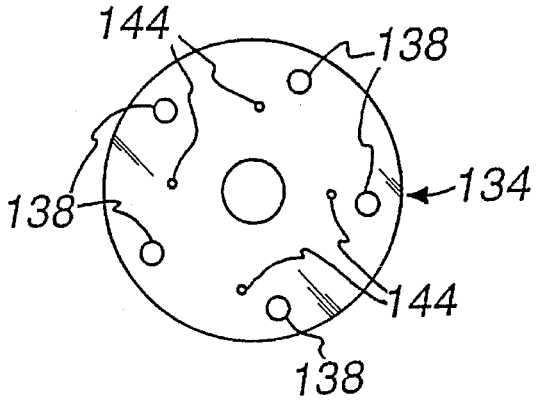

FIGS. 10 and 11 illustrate the rings 132 and 134 for securing the spring assembly 120 into a desired circular shape. The ring 132 includes a series of angularly spaced holes 136 sized and arranged to receive respective spring elements 124. Similarly, the ring 134 includes a lesser number of angularly-spaced holes 138 sized and arranged to receive the extensions 128 of the spring assembly 120. As detailed in FIG. 12, the assembled structure includes a large number of spring elements 124 located in a circle beyond the ring 132 with a smaller number of concentric extensions 128 projecting beyond the ring 134. The holes 130 in the extensions 128 are suitable for mounting further ornaments or chains.

The depicted extensions 128 would generally be too short to exert a sufficient elastic spring force over a desired deflection distance. However, it is contemplated that the extensions could be lengthened and, in fact, be constructed to the same length as the spring elements 124. Thus a multi-tiered spring structure can be constructed according to this invention.

While the majority of extensions 128 are relatively short and project only slightly beyond the surface of the ring 134, a pair of elongated extensions 137 (FIGS. 9 and 12) are provided between the shorter extensions 128. These extensions are approximately the same length as the spring elements 124 and would, therefore, also act as springs. The elongated extensions 137 include holes 139 for receiving ornaments. As further detailed in FIG. 12, the extensions project from the overall structure in an opposing direction from the spring elements 124. The extensions 137 can, thus, act as a second tier of spring-loaded mounting locations for ornament strings.

A variety of attachment mechanisms can be utilized to retain the rings 132 and 134 in axial compression against the runner 122. In this embodiment, the rings 132, 134 include holes 142, 144, respectively mounted radially inwardly from the spring assembly holes 136, 138 respectively. These holes 142 and 144 are aligned with each other both radially and circumferentially when the two rings are mounted over the spring assembly. Thus, screws 148 and nuts 150 can be passed through the holes 142 and 144 to secure the rings together. As detailed in FIG. 11, the rings 132, 134 are secured in close-fitting engagement with the runner 122 which acts as a platform for supporting the rings 132 and 134. Likewise, a center shaft and bolt arrangement such as the shaft 116 and bolts 114 of FIG. 8 can be utilized according to this embodiment. Other attachable mechanisms are also contemplated.

While the foregoing embodiments, as illustrated in FIGS. 1–12, relate generally to a spring assembly for applying tension to ornament strings that radiate outwardly from the spring assembly, it is contemplated that the spring assembly can be applied to the more-outward frame member and apply tension to strings that radiate inwardly from the spring assembly. Additionally, as noted above, the spring assemblies illustrated according to this embodiment need not be used only in a spoke-and-hub arrangement, but are applicable to a variety of shapes and sizes of chandeliers. It is contemplated primarily that the spring elements according to the preceding embodiments be constructed to engage a plurality or ornament strings simultaneously.

Figure 12:
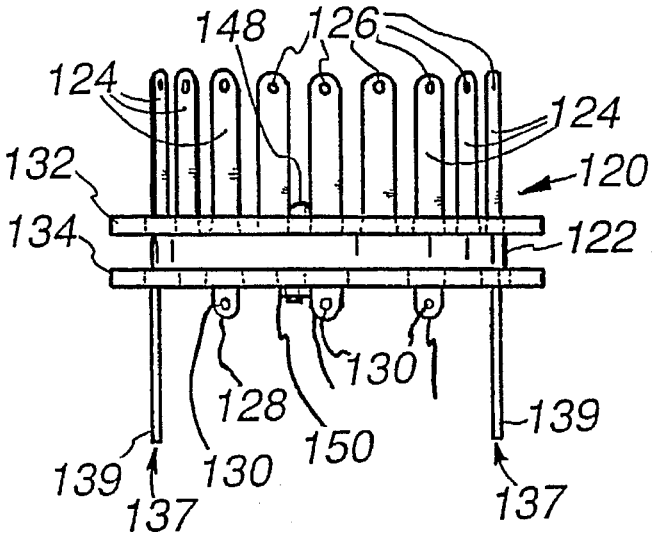
FIG. 12 is a side view of an assembled spring assembly and frame members according to FIGS. 9, 10 and 11.

FIG. 12 illustrates an alternate embodiment of a spring assembly 200 according to this invention. The spring assembly 200 is formed from an integral piece of spring material (such as full hard 302 stainless steel or spring steel) having a thickness of 0.015" inch. The spring assembly 200 defines a central hub 202 and a plurality of radial spring elements 204 extending radially outwardly from the central hub 202. Each spring element 204 according to this embodiment has a length L2 from the hub 202 to a respective end 206 of approximately ¾ inch and a width W2 of approximately ⅛ inch. Each spring element 204 includes, adjacent its end 206, a hole 208 for receiving an ornament hook of predetermined shape and size. Note that the ends 206 of the spring elements 204 define an enlarged rounded segment. The rounding and enlargement of the ends 206 ensure sufficient material around the hole 208 and prevents possible injury from sharp corners.

It is contemplated that the length L2 and width W2 of each spring element can be varied based upon the particular application of the spring assembly 200 according to this invention. The spring element 204 should provide a sufficient spring tension to a string attached to a hole 208 without breaking the string and that the spring element should permit sufficient displacement of the string to enable it to be easily attached to, and detached from, its respective attachment locations.

Figure 14:
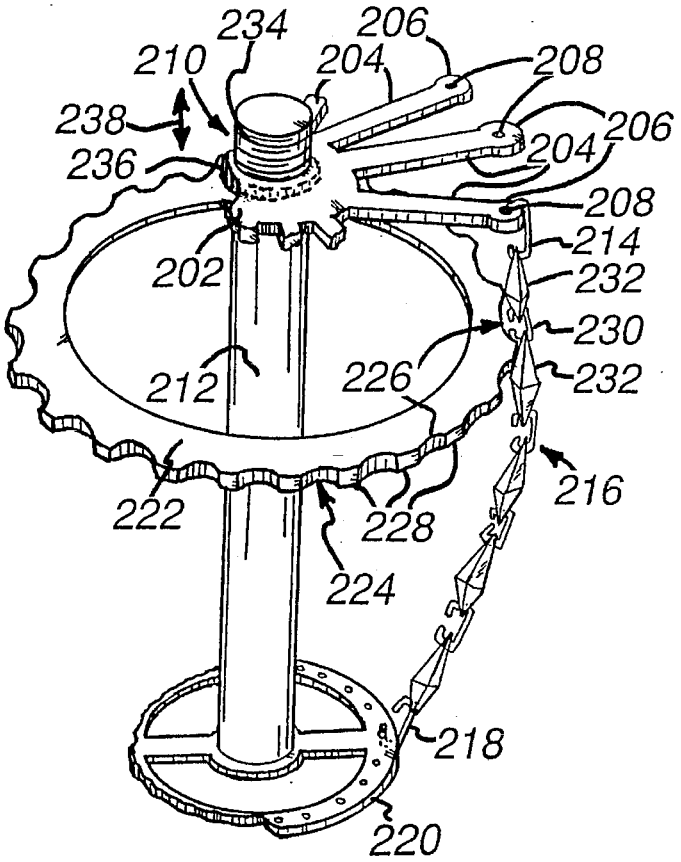
FIG. 14 is a partial perspective view of a chandelier frame including the ornament string spring assembly of FIG. 13.

FIG. 14 details and implementation of the spring assembly 200 according to this embodiment. The central hole 210 of the spring assembly is used for mounting the spring assembly 200 on the central rod 212. The area surrounding the hole 210 can be considered a common "runner" according to this embodiment from which each spring element 204 radiates in a radial direction. The spring element 204 is attached via the hole 208 to end hook 214 of an ornament string 216. The opposing end hook 218 of the ornament string 216 is attached to a ring 220 that, according to this embodiment, is fixed axially upon the rod 212. Each spring element 204 provides a tension to the string 216, since the spacing between hole 208 and ring 220, when the element 204 is unstressed, is greater than the length of the string 216 between hooks 208 and 218. In other words, the element 204 must be flexed and displaced toward the ring 220 for it to interconnect with the hook 208.

An optional intermediate ring 222 is located along the length of the rod 212. The ring 222 includes an outer surface 224 having radially-inward undulations 226 that are interposed between radially-outward undulations 228. It is contemplated that the number of radially-inward undulations 226 is equal to the number of spring elements 204. According to this embodiment, each chain 216 can be seated within an inward undulation 226. As depicted in FIG. 14, the link 230 rests upon one of the inward undulations 226. The ring 222, according to this embodiment, has a radius that is larger than the radius of the hole 208 relative to the center of the spring assembly 200. Accordingly, the string bulges around the ring as it spans the distance from the spring element 204 to the lower ring 220. The ring 222 can be fixed to the rod or, as depicted, can be free-floating, when a plurality of strings surround the ring, it remains relatively concentric with the center rod 212. The ring 222 will also generally remain axially-fixed as it rests between two ornaments 232 in engagement with a link 230 on each string 216.

A thread section 234 is provided to the rod 212. A knurled nut 236 rides upon the thread section 234 and supports the center hub 202 of the spring assembly 200. By rotating the nut 236 according to this embodiment, the axial location of the spring assembly 200 relative to the rod 212 can be changed (double arrow 238). The use of an adjusting nut can be desirable when some strings of ornaments are longer than others and, by increasing the spacing of the spring assembly 200 relative to the lower ring 220, all strings can be imparted with a predetermined tension. Similarly, if the spacing is too large for some strings, the nut 236, can be rotated to decrease the spacing between the spring assembly 200 and the lower ring 220 to ensure that no string receives too much tension. Additionally, the use of nut 236 can be desirable when using intermediate expanding rings such as the intermediate ring 222. It can sometimes prove difficult to accurately gauge the spacing required between the spring assembly 200 and the lower ring 220 when several intermediate rings are interposed along the length of the rod 212. Accordingly, the adjustment nut enables the assembler to make fine adjustments to the tension imparted upon the strings once all of the strings have been attached to the chandelier frame structure.

Figure 15:
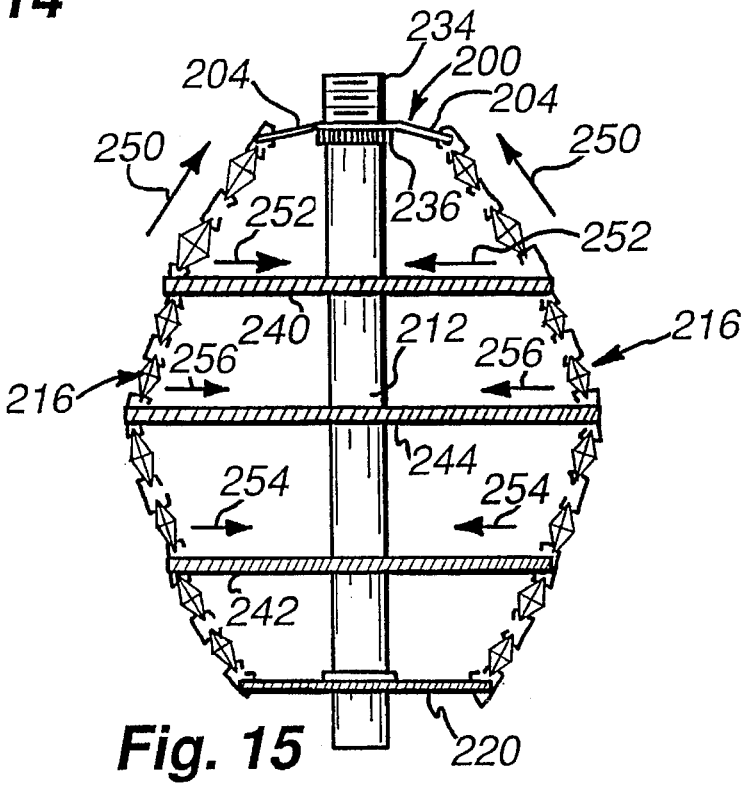
FIG. 15 ms a somewhat-schematic cross-section of a chandelier frame utilizing the spring assembly of FIG. 13.

A frame structure that utilizes multiple intermediate rings is further detailed in FIG. 15. A set of smaller diameter rings 240 and 242 are located adjacent the spring assembly 200 and lower ring 220, respectively. A larger diameter ring 244 is located at the approximate center point along the rod 212 between the spring assembly 200 and lower ring 220. The rings 240, 242 and 244 generate an urn-like shape in the strings 216. Note that the spring assembly 200 is flexed downwardly as it rests upon the nut 236. The flexure in the spring assembly translates into a tension force (arrows 250) in the strings 216. The tension force is resolved into a radially-inward force (arrows 252, 254 and 256) that act upon each of the rings 240, 242 and 244 respectively. The radially-inwardly-acting forces maintain the rings in place relative to the rod 12.

Figure 16:
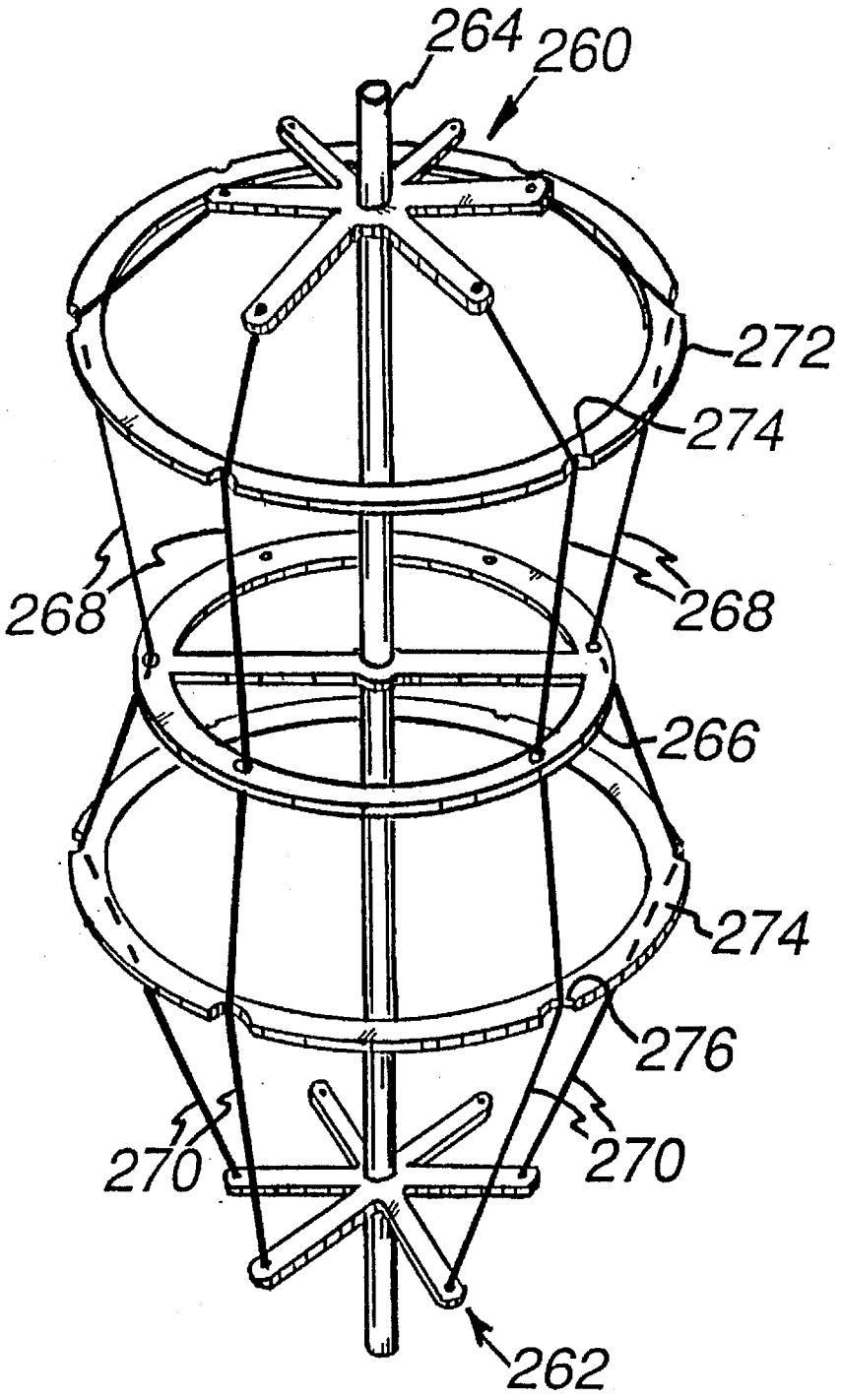
FIG. 16 is a schematic perspective view of a chandelier frame utilizing a pair of spring assemblies of FIG. 12.

As further detailed schematically in FIG. 16, a variety of unique shapes can be generated using spring assemblies according to this embodiment. As illustrated, a pair of spring assemblies 260 and 262 are located at opposing ends of a rod 264. A central ring 266 is fixed to the rod 264 at a point approximately equidistant (taken along an axial direction) between each of the spring assemblies 260 and 262. A series of upper strings 268 are joined between the upper spring assembly 260 and the center ring 266. A pair of lower strings 270 are also joined to the center ring 266 and the lower spring assembly 262. The upper and lower spring assemblies are adjusted in impart tension to their respective strings 268 and 270. A pair of intermediate rings 272 and 274 are provided to form bulges in the upper string 268 and lower strings 270 respectively. The rings 272 and 274 include undulations 274 and 276, respectively, for receiving strings. While undulations are used according to a preferred embodiment, a variety of intermediate ring surface shapes are contemplated. For example, the rings can be provided with holes, and portions of strings can be passed through the holes. Additionally, hooks can be located on intermediate rings that interconnect with portions of strings.

The spring assembly, having a plurality of radially-extending spring elements need not be attached to a rod according to this embodiment. For example, a semicircle of spring elements can be employed to form, for example, a half-cylinder. This shape can be desirable for producing a wall sconce that encloses a light element. Similarly, the hub (202 in FIG. 13) is relatively small in diameter according to this embodiment. A larger diameter hub can be utilized or, conversely, the hub can be substituted for a ring structure that attaches directly to an enlarged chandelier frame ring. In this manner, the spring elements can be located on a large diameter frame member and provide tension to strings that extend from the large diameter frame member to a smaller diameter frame member.

Figure 17:
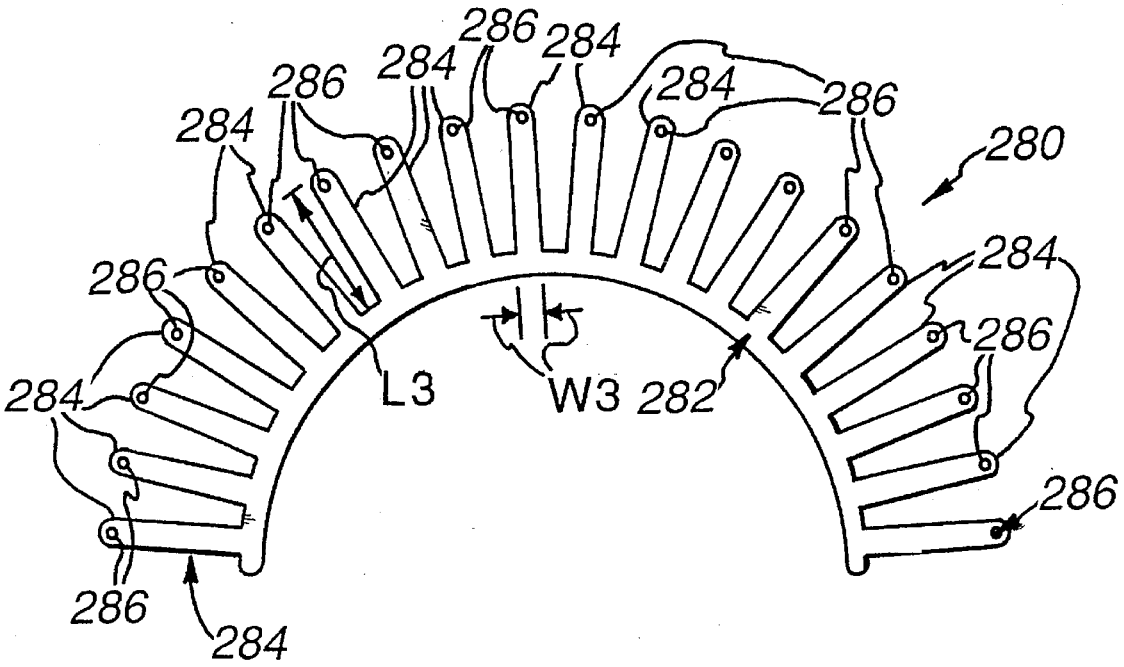
FIG. 17 ms a plan view of a spring assembly according to another embodiment of this invention.

Another embodiment of a spring assembly 280 according to this invention is detailed in FIGS. 17–21. As discussed above, with reference to the embodiment of FIGS. 13–16, the spring assembly of this invention can be formed into a ring structure with a series of radially-extending spring elements projecting from a central hub. FIG. 17 illustrates a spring assembly 280 having a curved runner 282 from which a plurality of spring elements 284 project. The runner 282, according to this embodiment, defines a semicircle and the spring elements 284 are located at approximately equal angular distances from each other along the semicircular runner 282. Each spring element, according to this embodiment, also includes a hole 286 at its outer end to receive an ornament string hook.

Figure 18:
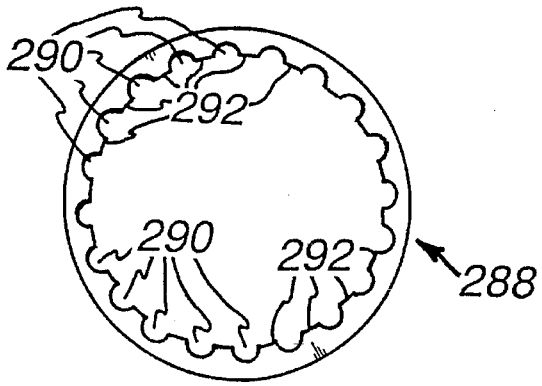
FIG. 18 ms a plan view of a frame member for use with the spring assembly of FIG. 17.

While the spring assembly 280, can be employed in a manner described above with reference to FIGS. 13–16, the spring assembly 280 of this embodiment is sized and arranged to interengage with a frame member ring 288 as detailed in FIG. 18. The ring 288 includes a plurality of undulations 290 located along its inner circumference. The undulations according to this embodiment are formed as a series of semicircles. The number of undulations 290 in ring 288 equals the number of spring elements 284 in the spring assembly 280.

Figure 19:
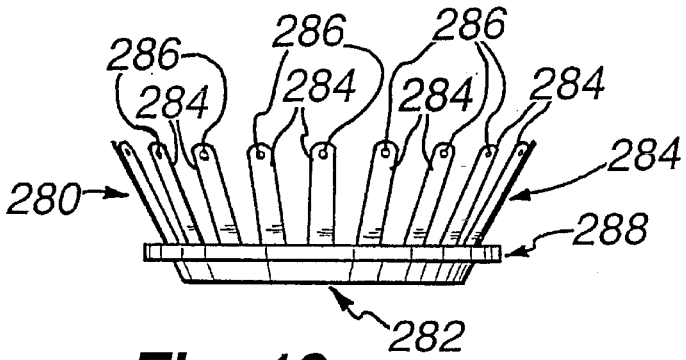
FIG. 19 is side view of an assembled spring assembly and frame member of FIGS. 17 and 18.
Figure 20:
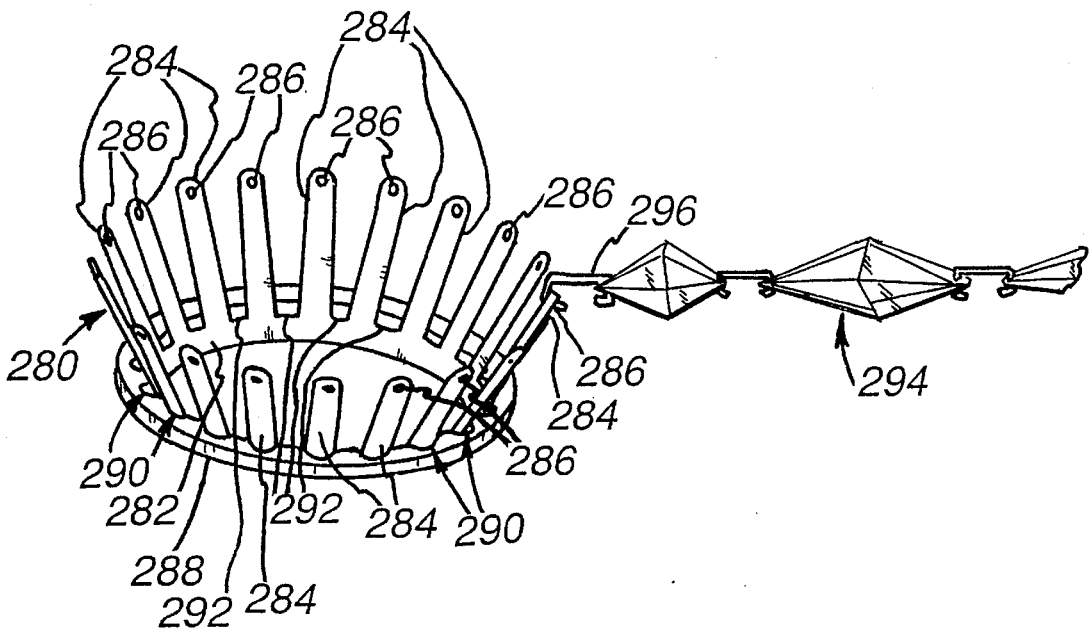
FIG. 20 ms a perspective view of the assembled ornament string spring assembly and frame member of FIG. 19 including an attached ornament string.

With reference to FIGS. 19 and 20, the spring assembly 280 is constructed to rest within the undulations 290 of the ring 288. The runner 282 must be formed into a ring and seated into the inner circumference of the frame member 288. The outwardly-acting spring tension generated in the runner 282 when it is formed into a ring causes the spring elements to bear against each respective undulation into which they are seated. The spring tension causes the spring elements to remain firmly engaged against the frame member and also causes the spring elements to flare outwardly, as shown to define in an inverted cone section (frustoconical shape). The runner 282 forms a stop against the bottom of the ring 288 as it engages the center extensions 292 formed between each recessed undulation 290. The inner engagement between the extensions 292 and the runner 282 prevents the spring force generated by the compressed spring assembly 280 from driving the spring assembly upwardly out of the ring 288.

As detailed in FIG. 20, each spring element 284 can receive an ornament string 294 by interengagement of a string hook 296 with a respective hole 286 of a spring element 284. The slanted orientation of the spring elements 284 (due to their inverted cone shape) makes the spring assembly and ring structure of this embodiment particularly suited for either vertical, horizontal, or diagonal radial extension of strings. In other words, a string can be located horizontally relative to the plane of the ring 288 (as shown) or can be located at an angle (frustoconically) relative to the plane of the ring 288. Additionally, since the spring elements 284 extend outwardly at an angle relative to the plane of the ring, it is possible to place strings in a vertical relationship that is substantially perpendicular to the plane of the ring. Each string would hang outwardly from the outer circumference of the ring 288. This arrangement is detailed in partial cross-section in FIG. 21.

The spring assembly 280 according to this embodiment includes a runner having an approximate radius of 1½ inches with spring elements having a length L3 of ¾ inch and a width W3 of ⅛ inch. The ring 288 has an approximate inner-circumferential radius of 1⅝ inches and each semi-circular undulation 290 has a radius of 5/64 inch.

Figure 13:
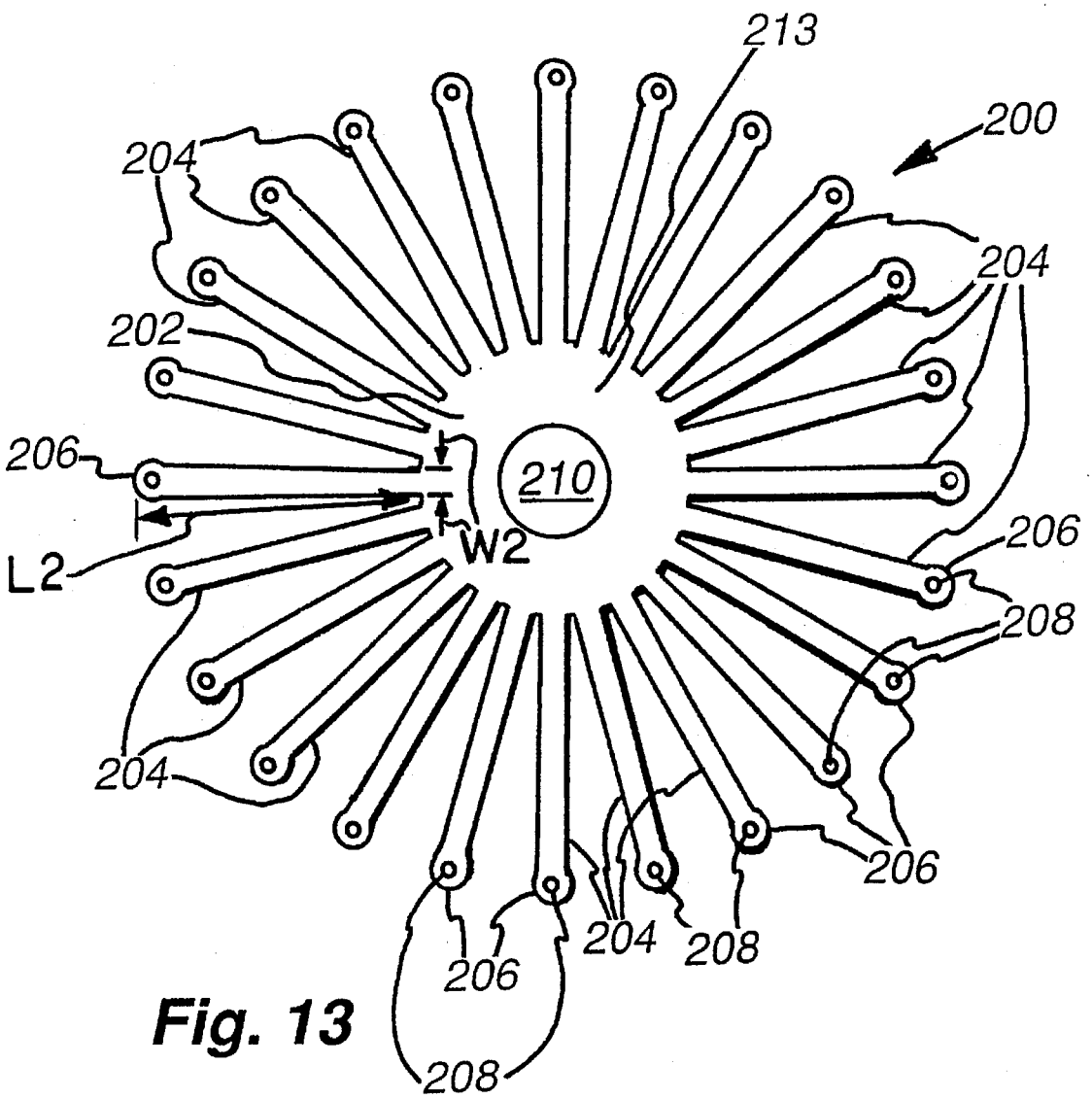
FIG. 13 is a plan view of a spring assembly according to another embodiment of this invention.
Figure 21:
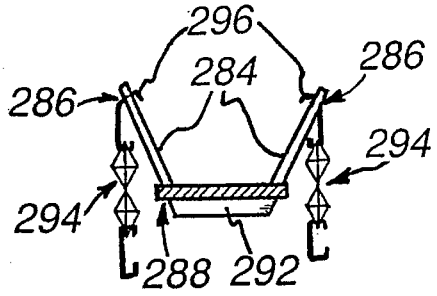
FIG. 21 is a partial side cross-section of an alternate orientation of ornament strings according to the embodiment of FIG. 20.

FIG. 21 illustrates another embodiment of a spring assembly structure 300 based upon the spring assembly shown and described in FIG. 13. The spring assembly 300 includes a series of spring elements 302 that are largely-irregular in shape and length. Each of the spring elements 302 radiate from a central ring 304 with a mounting hole 306. However, attachment locations or holes 308 for each spring element 302 are located at a different, non-identical, radial distance relative to the center of the ring 304.

Figure 22:
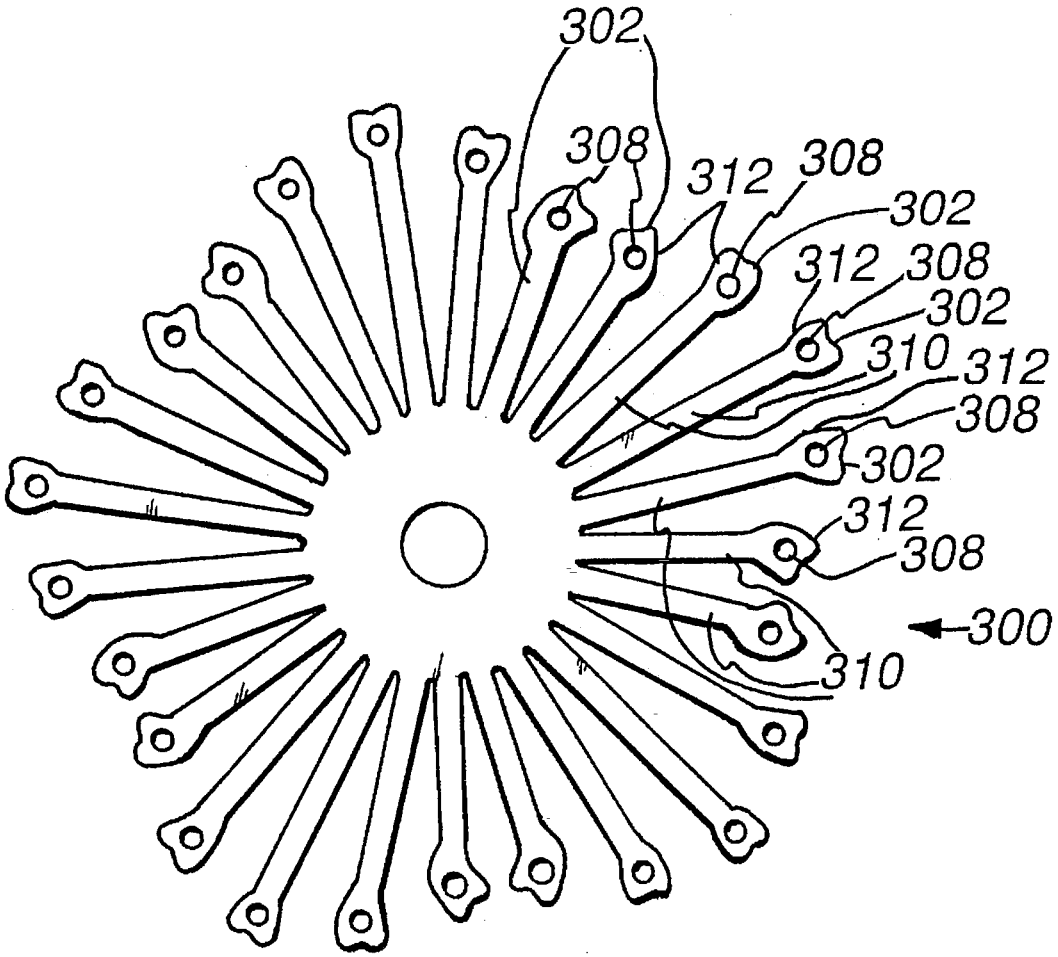
FIG. 22 is a plan view of a spring assembly according to another embodiment of this invention.

The embodiment of FIG. 22 illustrates that a spring assembly according to this invention can be constructed using irregular or ornamental spring elements. The spring elements typically include an elongated leaf spring section 310 that is narrow to enable flexure. Variation in the shape and width of the leaf spring section 310 contemplated. Likewise, the ends 312 of each spring element 302 can be largely-variable in shape and size. Each spring element should be sized so that it provides sufficient tension force to a desired string of ornaments. Otherwise size and shape of spring elements can be largely varied.

It is contemplated that varied size and shape spring elements can be provided to a linear runner such as that disclosed in the embodiment of FIGS. 1–12. Such elements can also be provided to a semi-circular runner such as that disclosed in the embodiment of FIGS. 17–21. Such spring elements should include a narrowed elongated section that enables flexure and an end portion suitable for mounting ornaments. Likewise, attachment locations need not comprise holes, but can comprise any acceptable mechanism for attaching an end of a string of ornaments.

It should be clear from the preceding description that each of the spring assemblies described herein can be constructed relatively easily using computer-aided design techniques in conjunction with automated metal-stamping or cutting equipment. In particular, it is contemplated that a laser cutter of conventional design can be programmed to form spring assemblies and frame member rings for supporting the spring assemblies from sheet material stock. Such laser cutters can be supplemented with a punch mechanism that forms holes and tight-radius corners in various components, according to this invention. Additionally, while the frame members according to this embodiment are typically formed from mild steel having a thickness of between ⅛ and 3/16 inch, a variety of thicknesses, hardnesses and grades of metal can be utilized according to this invention. Additionally, polymers and plastics can be substituted for any of the materials used herein. Spring assemblies can be manufactured from resilient plastics. Likewise, frame member rings can be manufactured from non-metallic materials. It is contemplated generally that the spring assembly should be sufficiently resilient and long-lived for use with chandelier ornament strings. Likewise, the frame members should be sufficiently stiff so that the chandelier frame does not experience misalignment and the frame members do not, themselves, deform under force applied by the spring assemblies.

Accordingly, the foregoing has been a detailed description of preferred embodiments but, as described above, various modifications and additions can be made without departing from the spirit and scope of this invention. This description, therefore, is meant to be taken only by way of example and not to otherwise limit the scope of the invention.

What is claimed is:

1. A stretchable chandelier ornament string assembly comprising:

a first chandelier ornament string having a first end and a second end;

a second chandelier ornament string having a first end and a second end; a chandelier frame, the first end of each of the first ornament string and the second ornament string being attached to attachment locations on the chandelier frame, the chandelier frame including a rigid frame member; and a spring assembly attached to the rigid frame member comprising a first spring element and a second spring element interconnected by a common runner and extending transversely from the common runner, each of the first spring element and the second spring element defining attachment locations engaging a respective second end of each of the first ornament string and the second ornament string and providing spring tension to each of the first ornament string and the second ornament string and the common runner being deformed into a deformed shape about a portion of the rigid frame member under spring force wherein the spring force and the deformed shape of the common runner are maintained by the rigid frame member.

2. The stretchable chandelier ornament string assembly as set forth in claim 1 wherein each of the first spring element and the second spring element comprise elongated leaf springs extending along a direction of elongation that is substantially transverse to the runner and wherein the runner is elastically deformed into at least a portion of a ring.

3. The stretchable chandelier ornament string assembly as set forth in claim 2 wherein the runner includes a width and a thickness and wherein the thickness is substantially less than the width, and wherein the runner is bent about its thickness and engages the chandelier frame.

4. The stretchable chandelier ornament string assembly as set forth in claim 3 wherein the rigid frame member comprises a plate having a plurality of holes therein, each of the holes respectively receiving each of the first spring element and the second spring element the holes being constructed and arranged on the frame member so that the common runner is forced into the deformed shape.

5. The stretchable chandelier ornament string assembly as set forth in claim 4, wherein the plurality of holes define at least a portion of a loop having a center axis and wherein each of the first ornament string and the second ornament string extends inwardly toward the center axis.

6. The stretchable chandelier ornament string assembly as set forth in claim 4, wherein the plurality of holes define at least a portion of a loop having a center axis and wherein each of the first ornament string and the second ornament string extends outwardly from the center axis.

7. A stretchable chandelier ornament string assembly comprising;

a first chandelier ornament string having a first end and a second end;

a second chandelier ornament string having a first end and a second end;

a chandelier frame the first end of each of the first ornament string and the second ornament string being attached to attachment locations on the chandelier frame, the chandelier frame including a rigid frame member;

a spring assembly attached to the rigid frame member comprising a first spring element and a second spring element interconnected by a common runner and extending transversely from the common runner, each of the first spring element and the second spring element defining attachment locations engaging a respective second end of each of the first ornament string and the second ornament string and providing spring tension to each of the first ornament string and the second ornament string; and wherein the runner defines a ring shape and wherein each of the first spring element and the second spring element define leaf springs that extend radially relative to the ring shape.

8. The stretchable chandelier ornament string assembly as set forth in claim 7 wherein the spring assembly, in an undeformed state, defines a plane and wherein each of the first ornament string and the second ornament string extend transversely relative to the plane.

9. The stretchable chandelier ornament string assembly as set forth in claim 8 wherein the spring assembly includes a center post extending transversely to the plane and wherein each of the first ornament string and the second ornament string are attached at each respective first attachment location on a frame member located along the center post at a position remote from the plane.

10. The stretchable chandelier ornament string assembly as set forth in claim 9 further comprising a central frame member located along the center post between the spring assembly and the respective first attachment location of each of the first ornament string and the second ornament string wherein the central frame member engages each of the first ornament string and the second ornament string and is located radially-outwardly from the center post at a distance that is greater than each of the first attachment locations and the second attachment locations relative to the center post whereby a bulge in each of the first ornament string and the second ornament string relative to the center post is formed.

11. A stretchable chandelier ornament string assembly comprising:

a plurality of spring elements extending transversely to a common runner formed on a piece of spring material;

a chandelier frame member interconnected with the runner and maintaining the spring elements in a non-planar orientation;

a plurality of ornament strings each interconnected with each of the spring elements and tensioned by each of the spring elements, wherein each of the ornament strings are connected between a respective of the spring elements and a respective opposing attachment location on a chandelier frame; and wherein the frame member includes a plurality of retaining structures having at least some of the plurality of spring elements located therethrough, wherein the retaining structures maintain the runner in a non-planar orientation.

12. The stretchable chandelier ornament string assembly as set forth in claim 11 wherein the retaining structures define a plurality of holes in the frame member.

13. A stretchable chandelier ornament string assembly comprising;

a plurality of spring elements extending transversely to a common runner formed on a piece of spring material;

a chandelier frame member interconnected with the runner and maintaining the spring elements in a non-planar orientation;

a plurality of ornament strings each interconnected with each of the spring elements and tensioned by each of the spring elements, wherein each of the ornament strings are connected between a respective of the spring elements and a respective opposing attachment location on a chandelier frame; and wherein the runner comprises a semicircular strip and wherein each of the spring elements extends radially relative to a semicircle defined by the semicircular strip.

14. The stretchable chandelier ornament string assembly as set forth in claim 13 wherein the frame member comprises a ring having a plurality of detents for receiving at least some of the plurality of spring elements wherein the spring elements extend from the ring in an approximately frustoconical shape.

15. A method for constructing a stretchable chandelier ornament string assembly comprising:

forming a spring assembly having a plurality of spring elements joined by a common runner from a substantially flat piece of spring material, the spring elements extending transversely to the runner;

attaching the spring assembly to a rigid chandelier frame member, including deforming the runner during the step of attaching to form a non-planar runner; and attaching a chandelier ornament string to each of the plurality of spring elements and displacing each of the plurality of spring elements to tension each of the ornament strings.

16. The method as set forth in claim 15, wherein the step of deforming includes locating at least some of the plurality of spring elements in interengaging formations in the rigid frame member and retaining the spring assembly relative to the rigid frame member by spring force generated in the runner.

17. A method for constructing a stretchable chandelier ornament string assembly comprising:

forming a spring assembly having a plurality of spring elements joined by a common runner from a substantially flat piece of spring material, the spring elements extending transversely to the runner;

providing opposing extensions that extend from the runner in a direction opposite a direction that at least some of the spring elements extend from the runner;

attaching the spring assembly to a chandelier frame member, wherein the step of attaching includes providing a pair of frame members that engage each of the plurality of spring elements and the extensions on opposing sides of the runner wherein the spring assembly is formed by the pair of frame members into a non-planar orientation; and attaching a chandelier ornament string to each of the plurality of spring elements and displacing each of the plurality of spring elements to tension each of the ornament strings.

18. The method as set forth in claim 17 wherein the spring elements approximately define a surface that comprises at least a portion of a cylinder.

19. A method for tensioning a plurality of chandelier ornament strings on a chandelier frame comprising:

providing a plurality of spring elements interconnected by a common runner and attached to a frame member of the chandelier frame including providing spring elements that extend radially outwardly from a center and that, in a non-deformed state, lie approximately within a plane; and attaching each of a plurality of chandelier ornament strings between a respective of the plurality of spring elements and a portion of the chandelier frame remote from each of the plurality of spring elements, the step of attaching including displacing each of the spring elements to generate a tension force that is imparted to each of the plurality of ornament strings, wherein the step of attaching includes locating each of the plurality of ornament strings at least in part along lines that extend transversely to the plane.

20. The method as set forth in claim 19 wherein the step of providing includes cutting the plurality of spring elements and the common runner as a continuous assembly from a piece of flat spring stock.

* * * * *